US008582793B2

(12) United States Patent
Baechler et al.

(10) Patent No.: US 8,582,793 B2
(45) Date of Patent: Nov. 12, 2013

(54) METHOD FOR DETERMINING OF FEEDBACK THRESHOLD IN A HEARING DEVICE AND A HEARING DEVICE

(75) Inventors: Patrick Baechler, Gutenswil (CH); Bernd Waldmann, Maur (CH); Andreas Von Buol, Zurich (CH); Stefan Pislak, Stafa (CH)

(73) Assignee: Phonak AG, Stafa (CH)

( * ) Notice: Subject to any disclaimer, the term of this patent is extended or adjusted under 35 U.S.C. 154(b) by 678 days.

(21) Appl. No.: 12/679,134

(22) PCT Filed: Sep. 20, 2007

(86) PCT No.: PCT/EP2007/060000

§ 371 (c)(1),
(2), (4) Date: Mar. 19, 2010

(87) PCT Pub. No.: WO2008/000842

PCT Pub. Date: Jan. 3, 2008

(65) Prior Publication Data

US 2010/0310103 A1 Dec. 9, 2010

(51) Int. Cl.
*H04R 25/00* (2006.01)

(52) U.S. Cl.
USPC ..... 381/318; 381/312

(58) Field of Classification Search
USPC ..... 381/60, 312, 313, 314, 316, 317, 318
See application file for complete search history.

(56) References Cited

U.S. PATENT DOCUMENTS

| | | | | |
|---|---|---|---|---|
| 5,991,417 | A * | 11/1999 | Topholm | 381/60 |
| 6,134,329 | A | 10/2000 | Gao et al. | |
| 6,876,751 | B1 | 4/2005 | Gao et al. | |
| 2004/0190739 | A1 * | 9/2004 | Bachler et al. | 381/314 |
| 2004/0202340 | A1 * | 10/2004 | Armstrong et al. | 381/312 |
| 2005/0232452 | A1 * | 10/2005 | Armstrong et al. | 381/317 |
| 2006/0140429 | A1 * | 6/2006 | Klinkby et al. | 381/317 |
| 2006/0291681 | A1 * | 12/2006 | Klinkby et al. | 381/318 |
| 2007/0297627 | A1 * | 12/2007 | Puder | 381/318 |

FOREIGN PATENT DOCUMENTS

| | | | |
|---|---|---|---|
| EP | 1309225 | A1 | 5/2003 |
| EP | 1624719 | A1 | 2/2006 |
| WO | 2006136615 | A2 | 12/2006 |
| WO | 2008000843 | A2 | 1/2008 |

OTHER PUBLICATIONS

International Search Report for PCT/EP2007/060000 dated Jun. 12, 2008.
Written Opinion for PCT/EP2007/060000 dated Jun. 12, 2008.

* cited by examiner

*Primary Examiner* — Duc Nguyen
*Assistant Examiner* — Phan Le
(74) *Attorney, Agent, or Firm* — Pearne & Gordon LLP

(57) ABSTRACT

A method for determining feedback thresholds in a plurality of frequency bands and/or at a plurality of frequencies processed by a hearing device is disclosed. The feedback thresholds are defined as gains, at which feedback occurs while a hearing device user is wearing the hearing device. The method comprises the step of determining feedback thresholds in an order of precedence, wherein the order of precedence being defined according to a degree of importance that the feedback threshold is determined in a particular frequency band or at a particular frequency, respectively.

20 Claims, 3 Drawing Sheets

METHOD FOR DETERMINING OF FEEDBACK THRESHOLD IN A HEARING DEVICE AND A HEARING DEVICE

The present invention relates to a method for determining of feedback thresholds in a hearing device.

Hearing devices are electronic devices, in which sound is recorded by a microphone, is processed or amplified, respectively, in a signal processing unit, and is transmitted into the ear canal of a hearing device user via a loudspeaker that is also called receiver. The amplified or processed sounds, which are emitted by the receiver, are partially recorded by the microphone. In other words, it must be dealt with a closed loop comprising a hearing device with an output signal and an input signal. It must be noted that the path of the sound energy is not limited to transmission through air, but also comprises, as the case may be, a mechanical transmission from the output to the input, as e.g. over the housing of the hearing device (so-called body sound). Furthermore, one has realized that via a vent, which is actually used for pressure equalization between the ear canal of the hearing device user and the surrounding, or via electrical paths in the hearing device, signal feedback can occur. It has been shown that of all these possible components, the acoustic signal feedback contributes the largest part.

The mentioned effects can result in a squealing, which is very uncomfortable for the hearing device user and finally renders the hearing device unusable during the occurrence of the squealing. Although there exists the possibility to keep the gain in the hearing device so small that no squealing occurs. Therewith, the use of a hearing device is compromised, to be precise in particular for those applications, for which a large hearing loss must be compensated as it occurs for a person who is hard of hearing, because for such patients a comparatively large gain in the hearing device must be adjusted in order to obtain an adequate compensation.

Even more critical is a so called open-fitting that allows sound directly entering into the ear canal.

U.S. Pat. No. 6,876,751 discloses a hearing device incorporating means for cancelling a feedback signal in order to avoid squealing. Thereto, an algorithm is implemented in the signal processing unit of the hearing device.

For a successful implementation of such a feedback cancelling algorithm, all gain settings, in particular the maximum possible gain setting, for a hearing device must be known. The maximum gain setting is the gain, for which there occurs just no feedback. The maximum gain is used in a gain limiter unit that limits the gain in order to prevent squealing.

Methods to determine the feedback threshold in a hearing device are already known. In U.S. Pat. No. 6,134,329, such a method is described with the aid of which the transfer function of the hearing device is estimated from measurements, which are made with a hearing device inserted into the ear of a user. Thereby, the overall transfer function is calculated with different gain values without opening the closed loop.

An improved method for determining of a feedback threshold in a hearing device is disclosed in EP-1 624 719 A2. By this known teaching, a measurement of the reverse gain or of the maximum forward gain that will not cause squealing is proposed. These measurements are typically performed one frequency at the time, or one frequency band at a time, and the complete set of measurements for all relevant frequencies or frequency bands is then used in the algorithm for feedback cancelling or gain limitation.

The known measurement methods yield degraded results if the measurement methods are performed in a noisy environment. This is the reason why the teaching of EP-1 624 719 limits the level of the input signal to 55 dB SPL.

It is pointed out that one measurement is not sufficient but a series of measurements are necessary to fully cover the behavior of a hearing device. In practice, a series of measurements are performed in a sequence of frequencies starting, at the lowest frequency, for example at 100 Hz, and increasing the frequency stepwise up to the highest frequency, which is, for example, 8 kHz.

The series of measurements may have to be performed in an environment with intermittent noise, where the noise is either generated externally, if a soundproof booth is not available, or the noise may be generated by the patient. This is in particular encountered in a pediatric fitting, where the child patient cannot be instructed to remain silent throughout the series of measurements.

In such a situation, the audiologist can only choose between repeating the entire series of measurements, which prolongs the entire session, or by working without measured feedback limits, and relying on less accurate estimates based on hearing device style and/or vent diameter, for example.

Especially in a pediatric setting, the measurement itself may cause the patient to emit noise because the sounds produced by a measurement often discomfort a child patient that in turn expresses the discomfort by vocalizing. As a result thereof, the measurement must be repeated. Repeating an aborted measurement sequence will not help because the child patient will express his or her discomfort again.

It is therefore one object of the present invention to provide an improved method for determining maximum gains in a hearing device.

The mentioned object is reached by the features given in claim 1. Advantageous embodiments are given in further claims.

The present is directed to a method for determining feedback thresholds in a plurality of frequency bands and/or at a plurality of frequencies processed by a hearing device, the feedback thresholds being defined as gains, at which feedback occurs while a hearing device user is wearing the hearing device. The method according to the present invention comprises the step of determining feedback thresholds in an order of precedence, wherein the order of precedence being defined according to a degree of importance that the feedback threshold is determined in a particular frequency band or at a particular frequency, respectively. The order of precedence defines the sequence of frequency bands or frequencies, respectively, in which the determinations are carried out. In case the sequence of determinations is interrupted, e.g. by intermittent noise, the most important determinations of feedback thresholds already took place. The likelihood of repeating a sequence of determinations is in most cases dramatically reduced.

An embodiment of the method according to the present invention is characterized by further comprising the step of determining maximum gains in the frequency bands or at the frequencies, respectively, based on the corresponding feedback threshold determined in the particular frequency band or at the particular frequency, respectively, the maximum gain being below the corresponding feedback threshold. In particular, the maximum gain is just below the feedback threshold such that no feedback occurs if the gain of the hearing device is equal to the maximum gain.

A further embodiment of the method according to the present invention is characterized in that the order of precedence is predefined according to predefined degrees of importance for each frequency band or at each frequency, respectively.

A further embodiment of the method according to the present invention is characterized by adjusting or readjusting the order of precedence while determining feedback thresholds.

A further embodiment of the method according to the present invention is characterized by determining a new order of preference after determining a feedback threshold.

A further embodiment of the method according to the present invention is characterized in that the degree of importance depends on at least one of the following parameters:

maximum possible gain of the hearing device;

an interpolated or extrapolated gain;

a safety margin;

a noise penalty;

an edge penalty;

a neighbor penalty.

A further embodiment of the method according to the present invention is characterized by interpolating or extrapolating feedback thresholds lying in frequency bands or at frequencies, respectively, in or at which no feedback threshold has been determined.

A further embodiment of the method according to the present invention is characterized by determining a quality factor of the interpolated or extrapolated feedback threshold, and considering the interpolated or extrapolated feedback threshold as final if the quality factor meets minimum predefined requirements.

A further embodiment of the method according to the present invention is characterized in that an interpolated or extrapolated feedback threshold is final if the extrapolated or interpolated feedback threshold is greater than a maximum possible gain of the hearing device.

A further embodiment of the method according to the present invention is characterized by determining a quality index for a determined feedback threshold, and considering a determined feedback threshold as final if the quality index meets minimum predefined requirements.

A further embodiment of the method according to the present invention is characterized by simultaneously determining the quality index and the corresponding feedback threshold.

A further embodiment of the method according to the present invention is characterized by determining the quality index and the feedback threshold in succession.

A further embodiment of the method according to the present invention is characterized by determining the quality index and feedback threshold in different frequency ranges or frequency bands.

A further embodiment of the method according to the present invention is characterized by determining the quality index and feedback threshold in the same frequency range or frequency band.

A further embodiment of the method according to the present invention is characterized by using one microphone for determining the feedback threshold and the quality index.

A further embodiment of the method according to the present invention is characterized by using one microphone for determining the feedback threshold and by using another microphone for determining the quality index.

A further embodiment of the method according to the present invention is characterized in that the two microphones belong to the same hearing device.

A further embodiment of the method according to the present invention is characterized in that one of the two microphones belong to one hearing device, while the other microphone belongs to another hearing device, wherein both hearing devices belong to a binaural hearing system.

A further embodiment of the method according to the present invention is characterized in that the quality index is a noise level.

A further embodiment of the method according to the present invention is characterized in that a determined feedback threshold is considered to be final if the addition of the values for the noise level and for the determined feedback threshold is smaller than the maximum possible gain of the hearing device.

The present invention will be further described by referring to drawings showing exemplified embodiments of the present invention.

Figure 1:
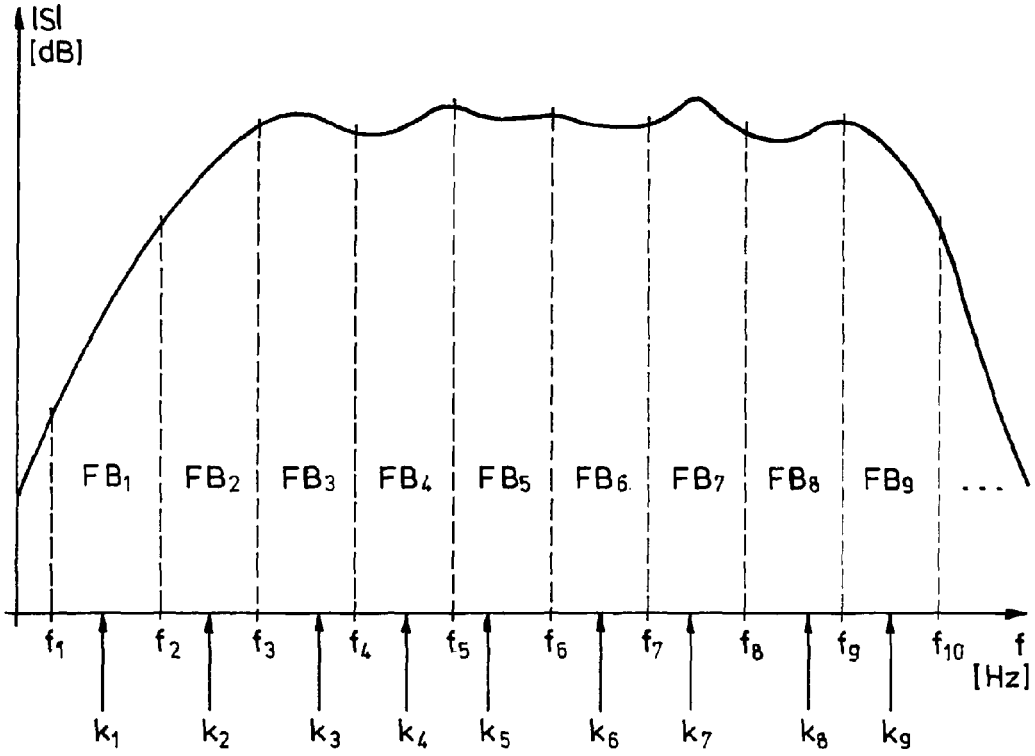
FIG. 1 shows a power spectrum of a transfer function of a hearing device.

FIG. 1 shows a power spectrum of a transfer function of a hearing device. The transfer function describes the input/output behavior of the hearing device, i.e. the input/output behavior of the components microphone, signal processing unit and receiver (loudspeaker) that are interconnected in sequence. The spectrum is divided into a plurality of frequency bands $FB_1$ to $FB_9$, wherein the frequency band $FB_1$ is defined by the interval starting at frequency $f_1$ and ending at frequency $f_2$. Generally, a frequency band $FB_n$ can be defined as follows:

$$FB_n=[f_n,f_{n+1}],$$

wherein n is an integer.

For illustration of another embodiment described later on, a frequency $k_1$ to $k_9$ is given in each of the frequency bands $FB_1$ to $FB_9$ represented in FIG. 1. The frequencies $k_1$ to $k_9$ can be at any position within the respective frequency band $FB_1$ to $FB_9$, for example.

In order to prevent feedback in the hearing device, maximum gains must be determined in the frequency bands $FB_1$ to $FB_9$ and/or at the frequencies $k_1$ to $k_9$. The values for the maximum gains are below feedback thresholds in those frequency bands $FB_1$ to $FB_9$ or at those frequencies $k_1$ to $k_9$, respectively; i.e. limiting the gains to the maximum gains in the specific frequency bands $FB_1$ to $FB_9$ or at the specific frequencies $k_1$ to $k_9$ results in that no squealing due to feedback occurs.

While in one embodiment of the present invention, maximum gains are determined in all frequency bands $FB_1$ to $FB_9$ or at all frequencies $k_1$ to $k_9$, respectively, in other embodiments of the present invention, some of the maximum gains are estimations because a measurement has not been possible in the corresponding frequency bands $FB_1$ to $FB_9$ or at the corresponding frequencies $k_1$ to $k_9$, respectively.

According to the present invention, a specific order of preference is determined that defines in which of the frequency bands $FB_1$ to $FB_9$ or at which of the frequencies $k_1$ to $k_9$ the feedback threshold, and subsequently the maximum gain, is determined.

In one embodiment, an order of preference of frequency bands or frequencies is chosen that maximizes the likelihood of obtaining a useful subset of measurements in a situation, where not all feedback thresholds can be measured because intermittent noise may cause the measurement to be aborted. A subset of measurements is useful if the measurements can be used to limit gain in other frequency bands, in which no measurement could have been made. At the same time, the success rate of preventing feedback is increased even though no measurement result is available. This general statement will become more apparent in the description that follows.

For example, measurements should be performed for sixteen frequency bands between 125 and 4000 Hz, spaced in ⅓ octave steps, i.e. 125, 160, 200, 250, 315, 400, . . . Hz.

In a first embodiment of the present invention, the measurement sequence (order of preference) starts with a small number of measurements at coarsely spaced frequencies or frequency bands followed by additional measurements, which successively refine the set. For the example with sixteen frequencies, the sequence might start at 250, 1000 and 4000 Hz, followed by 125, 500 and 2000 Hz, followed by 160, 320, 630, 1250, 2500 Hz, followed by 200, 400, 800, 1600, 3200 Hz. In this way, a coarse representation of the frequency response can be obtained very quickly, and if the measurement has to be aborted after the first six frequencies, for example, additional values at inter-octave frequencies can be interpolated. It is pointed out that the order of preference is predefined in this embodiment, i.e. the order of preference is not changed while determining feedback thresholds.

In a further embodiment of the present invention, the measurement sequence (order of preference) starts at frequencies, where someone versed in the art would expect feedback squealing to be most likely, e.g. near the ear canal resonance around 3000 Hz. For the example with sixteen frequency bands, the measurement might start in the frequency band, in which feedback occurs most likely, and then progress to frequency bands, in which feedback occurs less likely, e.g. in the sequence 3000 Hz, 3200 Hz, 2500 Hz, 4000 Hz, 2000 Hz, etc. In this way, the frequency response at the most likely frequencies is known if the measurement sequence has to be aborted after a few measurements. The order of preference is again predefined in this embodiment.

The frequency bands that are most likely to cause feedback problems are determined, in one embodiment of the present invention, based on general experience, i.e. knowledge of a group of patients having the same or similar desired settings or problems. In another embodiment of the present invention, the order of preference is determined based on knowledge of a particular hearing device user. In the latter case, a desired gain at each frequency is compared to average feedback thresholds at each frequency, whereas those frequencies are measured first where the difference or safety margin between the desired gain and an expected feedback threshold is the smallest. The determination of the order of preference is adjusted or readjusted, respectively, while performing the measurements or in-between measurements.

In general, a measurement of feedback threshold is performed at a frequency or in a frequency band, respectively, at or in which the highest probability exists that feedback is likely to occur. This can be expressed by a degree, which is hereinafter called degree of importance or just importance. The importance for a measurement at a certain frequency or in a certain frequency band, respectively, is a measure for the benefit that can be expected from the feedback measurement at a certain frequency. Therefore, the frequency band with the highest importance always promises the greatest benefit and is therefore the next frequency band, in which feedback is measured.

While most of the above-mentioned embodiments of the present invention have a fixed sequence of frequency bands or frequencies, respectively, i.e. the order of preference is predefined, further and more sophisticated embodiments of the present invention dynamically calculates the importance in order to dynamically determine the next frequency band, in which the next measurement of the feedback threshold will take place.

Figure 2:
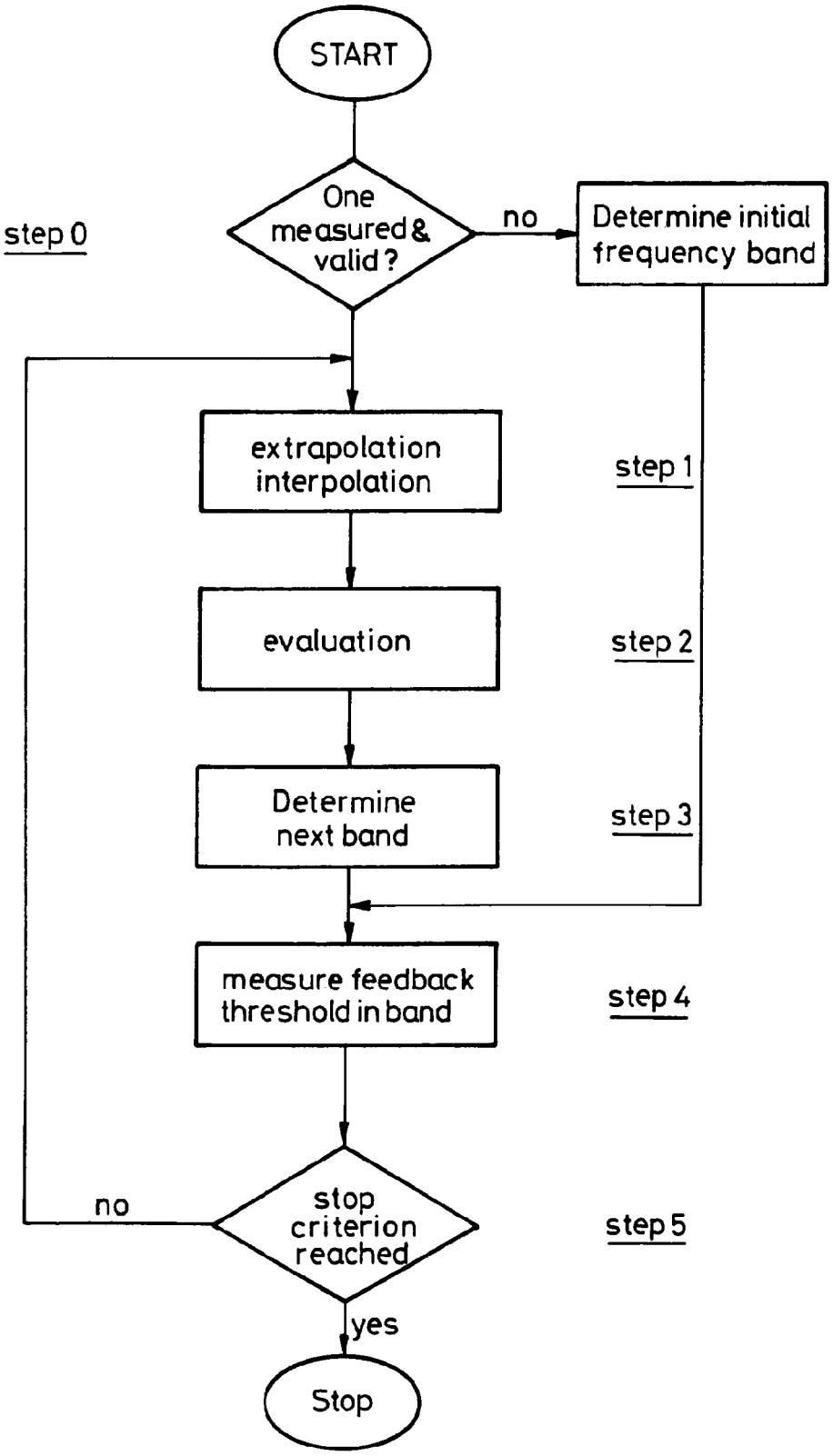
FIG. 2 shows a flow chart for a method according to the present invention.

FIG. 2 shows a flow chart for a method for determining a sequence of feedback measurements in a plurality of frequency bands or at a plurality of frequencies, respectively. It is pointed out that only the term "frequency band" is used in the following although, as already explained, also frequencies in the meaning explained in connection with FIG. 1 can be understood. Furthermore, each frequency band is assigned a plurality of flags controlling the method for determining the sequence of feedback measurements. A first flag is called "measured and valid", which means that the measurement of the feedback threshold has been performed and that the measurement is assumed to be useful. A second flag is called "measured but no feedback detected", and a third flag is called "measured but limited by background noise", which means that the result of the measurement is most likely not useful because the background noise has been found to be too high and therefore corrupted the result of the feedback measurement.

The present invention will now be explained by referring to the flow chart. However, it is pointed out that this flow chart only shows a possible implementation of the inventive concept. Therefore, it must not be used to limit the scope of the invention.

In the initial phase, indicated by step 0 in the flow chart of FIG. 2, the first frequency band, in which the maximum gain is determined, is selected. The criterions for selecting this first frequency band can be one or a combination of the following:

where feedback is most likely, for example around 3 kHz;

taking into account the comfort of the hearing device user; therefore, frequency bands allocated above 800 Hz are not considered.

After the first frequency band has been selected, the feedback threshold is measured according to step 4, which will be described later on.

If a feedback threshold has already been measured, i.e. if at least one flag is set to "measured and valid", the above-mentioned criterions of step 0 are not applied and the next step will be step 1, in which already measured feedback thresholds will be extrapolated and/or interpolated.

For the extrapolation/interpolation step (step 1), it is assumed that a number of feedback thresholds have been measured and that a flag "measured and valid" is assigned to at least one feedback threshold measurement.

Figure 3:
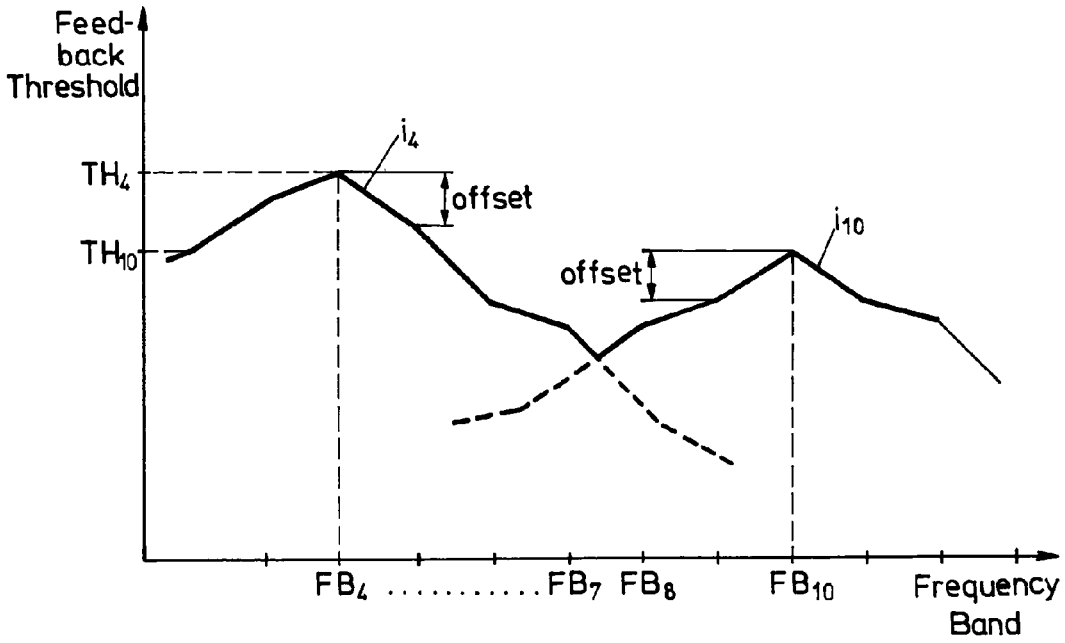
FIG. 3 shows a graph for feedback thresholds as a function of frequency bands.

FIG. 3 shows a graph for the feedback threshold as a function of the frequency bands $FB_k$, wherein feedback thresholds are only measured in the frequency bands $FB_4$ and $FB_{10}$. For each frequency band $FB_4$ and $FB_{10}$, in which the feedback thresholds have been measured, an extrapolation towards lower frequency bands, if any, and towards higher frequency bands, if any, is performed resulting in specific interpolation/extrapolation graphs $i_4$ and $i_{10}$ for the frequency bands $FB_4$ and $FB_{10}$. The graphs are constructed using a look-up table, for example, comprising offset values depending on the distance from a frequency band, in which a feedback threshold has been measured. The look-up table is based on empirical data, for example.

For example, the interpolated/extrapolated feedback threshold in a frequency band $FB_k$ is set either equal to the value of the interpolation/extrapolation graph $i_4$ or to the value of the interpolation/extrapolation graph $i_{10}$, whichever value is greater.

Step 2 is called evaluation step. In this step, it is checked whether a feedback threshold in any other frequency bands (i.e. frequency bands in which no feedback thresholds have been measured yet) can be considered as final. The criterions for a frequency band considered as final are as follows:

the flag "measured and valid" is not set;

the flag "measured and no feedback detected" is not set;

the extrapolated feedback threshold is greater than a maximum hearing device gain, wherein the maximum hearing device gain is the maximal possible gain for this hearing device and for this frequency band.

If these criterions are met, the flag "measured but no feedback detected" is set, and the value for the extrapolated feedback threshold is set to the value for the maximum hearing device gain plus the safety margin. Therewith, step 2 is concluded.

In the following step 3, the next frequency band is determined that is subject to a measurement of feedback threshold. The next frequency band is determined via the degree of importance, or simply importance, which is calculated for each frequency band for which the flag "measured and valid" or the flag "measured and no feedback detected" is not set. The frequency band with the highest importance will be the frequency band in which the feedback threshold is measured next. In fact, all frequency bands, for which the flags "measured and valid" or the flags "measured and no feedback detected" are not set, will be arranged according its importance. This results in a momentary order of preference for these frequency bands, the first of which being selected for the next feedback threshold measurement.

As has been already pointed out above, the importance is a measure for the benefit that can be expected from the feedback measurement at a certain frequency. For example, the importance for a frequency band i can be calculated in the following manner:

Importance=minimum of the values for the maximum gain of the hearing device and the gain obtained in the manner explained in connection with FIG. 3;

+ safety margin

− extrapolated gain according to step 1;

+ noise penalty value considering the surround quality (still further explained in the following);

+ edge penalty considering the vicinity of the minimum or the maximum frequency band in that the importance is reduced by a preset value for the frequency bands at or close to the edge;

+ neighbor penalty considering the vicinity of frequency bands that have a flag "measured and valid" being set; in general, the neighbor penalty gets larger, the further away the closest frequency band is having a flag "measured and valid" set.

Instead of considering all above-mentioned parameters, the importance can also be determined by considering a subset of the above-mentioned parameters.

Finally, the measurement of feedback threshold takes place in step 4 of the flow chart, the frequency band being either the one being determined in step 3 or the one being determined in step 0. The feedback threshold is determined according to the teaching of EP-1 624 719 A2, for example.

The result of the feedback threshold determination is qualified by an estimation or a measurement of the noise level while measuring the feedback threshold. This will be further explained in detail later on. In general, a sufficient quality of a measurement is obtained if the result of the addition of the values for the measured feedback threshold and for the noise level is smaller than the maximum power output (MPO) of the hearing device. If this condition is met, the flag "measured and valid" is set. If this condition is not met, the flag "measured but limited background noise" is set.

In step 5, one or a plurality of criterions are tested in order to determine whether the measurement shall be terminated or not, i.e. the steps 1 to 4 are repeated until one or a plurality of the following criterions are met:

all frequency bands got either a flag "measured and valid" or a flag "measured but no feedback detected" set;

a predefined number of noise checks returned an unreliable feedback threshold (the flag "measured but limited by noise" is set);

a manual stop button has been pressed by the audiologist, for example.

A further embodiment of the present invention and, another approach for optimizing measurements of feedback thresholds is presented in the following. It is pointed out that this further method can be independently implemented of the method described above. Therefore, the following method alone can be used to improve known feedback measurement methods. Nevertheless, a combination of this method with the method described above is also possible.

Generally, this method comprises the measurement of feedback thresholds in the manner described in step 4 (FIG. 2). The result of the measurement is qualified by an estimation or a measurement of the noise level while measuring the feedback threshold. This is, for example, accomplished during step 4 by using one microphone that is used to measure a feedback threshold in a selected frequency band $FB_1$ to $FB_9$ or at a selected frequency $k_1$ to $k_9$, respectively, and that is used, though in another frequency range or at another frequency, to measure the noise level. Thus, the two measurements take place at separate frequencies and therefore do not influence each other. The two measurements can be performed at the same time or subsequently.

In another embodiment of the present invention, two microphones are provided that are simultaneously used to measure feedback thresholds or maximum gains, respectively.

The two microphones belong to the same hearing device, for example. Hearing devices with two or more microphones are very well known, in particular when beam former algorithms are implemented. In the method according to the present invention, both microphones are used to improve the determination of maximum gain in the plurality of frequency bands $FB_1$ to $FB_9$ or at the frequencies $k_1$ to $k_9$, respectively. Thereby, one microphone is used to measure a corresponding feedback threshold, while the other microphone is used to measure the noise level. The two measurements are performed simultaneously and, preferably, in the same frequency band $FB_1$ to $FB_9$ or at the same frequency $k_1$ to $k_9$, respectively.

As has been pointed out above, the microphones used are anyway available in the hearing device. Using the microphones incorporated in the hearing device has the advantage of a simple implementation of the method according to the present invention that does not incur additional costs for hardware components. Nevertheless, and as a further embodiment of the present invention, an additional microphone being positioned in a way that a perfect recording of the noise level is possible will also result in an improved qualification of the measured feedback threshold.

In case a binaural hearing system is available comprising two hearing devices, it is also feasible to use a microphone of one hearing device to measure feedback threshold and to use a microphone of the other or contra-lateral hearing device to measure the noise level. In this situation, the microphone of the ipsi-lateral hearing device, in which the feedback occurs, is used to measure feedback threshold while the other microphone pertains to the hearing device in which no feedback is expected and therefore can very well be used to measure the noise level, in particular because of the sufficient distance, where a feedback signal is generated. Again, the measurement can be performed simultaneously or subsequently.

In a further embodiment of the present invention, determination of feedback thresholds is performed in a binaural hearing system in that in each of the two hearing devices each comprising two microphones, measurement of a threshold level and noise level is simultaneously performed in the left and the right hearing device. Thereby, any combination of microphones for recording a feedback threshold or noise level can be used. In a first example, the microphones of the left hearing device are used to determining feedback threshold in a specific frequency band or at a specific frequency, and the microphones of the right hearing device are used to determining feedback threshold in a specific frequency band or at a specific frequency.

In a second example, one of the microphones of the left hearing device is used to record noise level while one of the microphones in the right hearing device is used to determine the feedback threshold in the right hearing device in a specific frequency band or at a specific frequency. Again, the measurement can be performed simultaneously to shorten the whole measurement procedure.

In addition, the sequences of frequencies or frequency bands to be measured are, for example, different for the left and the right ear such that the measurements do not interfere.

The invention claimed is:

1. A method for determining feedback thresholds in a plurality of frequency bands ($FB_1, \ldots, FB_9$) and/or at a plurality of frequencies ($k_1, \ldots, k_9$) processed by a hearing device, the feedback thresholds being defined as gains, at which feedback occurs while a hearing device user is wearing the hearing device, the method comprising the step of determining feedback thresholds in an order of precedence, wherein the order of precedence is defined according to a degree of importance of the feedback threshold determined in a particular frequency band ($FB_1, \ldots, FB_9$) or at a particular frequency ($k_1, \ldots, k_9$), characterized in that the degree of importance for each frequency band ($FB_1, \ldots, FB_9$) or at each particular frequency ($k_1, \ldots, k_9$) represents a likelihood of feedback occurring at the frequency band ($FB_1, \ldots, FB_9$) or particular frequency ($k_1, \ldots, k_9$), and a frequency band or particular frequency having a higher likelihood of feedback is higher in the order of precedence than a frequency band or particular frequency having a lower likelihood of feedback.

2. The method of claim 1, characterized in that the order of precedence is predefined according to predefined degrees of importance for each frequency band ($FB_1, \ldots, FB_9$) or at each frequency ($k_1, \ldots, k_9$).

3. The method of claim 1, characterized by adjusting or readjusting the order of precedence while determining feedback thresholds.

4. The method of claim 1, characterized by determining a new order of precedence after determining a feedback threshold.

5. The method of claim 1, characterized in that the degree of importance depends on at least one of the following parameters:

maximum possible gain of the hearing device;

an interpolated or extrapolated gain;

a safety margin;

a noise penalty;

an edge penalty;

a neighbor penalty.

6. The method of claim 1, characterized by interpolating or extrapolating feedback thresholds lying in frequency bands ($FB_1, \ldots, FB_9$) or at frequencies ($k_1, \ldots, k_9$) in or at which no feedback threshold has been determined.

7. The method of claim 6, characterized by determining a quality factor of the interpolated or extrapolated feedback threshold, and considering the interpolated or extrapolated feedback threshold as final if the quality factor meets minimum predefined requirements.

8. The method of claim 6, characterized in that an interpolated or extrapolated feedback threshold is final if the extrapolated or interpolated feedback threshold is greater than a maximum possible gain of the hearing device.

9. The method of claim 1, characterized by determining a quality index for a determined feedback threshold, and considering a determined feedback threshold as final if the quality index meets minimum predefined requirements.

10. The method of claim 9, characterized by simultaneously determining the quality index and the corresponding feedback threshold.

11. The method of claim 9, characterized by determining the quality index and feedback threshold in succession.

12. The method of claim 9, characterized by determining the quality index and feedback threshold in different frequency bands or at different frequencies.

13. The method of claim 9, characterized by determining the quality index and the feedback threshold in the same frequency band or at the same frequency.

14. The method of claim 9, characterized by using one microphone for determining the feedback threshold and the quality index.

15. The method of claim 9, characterized by using one microphone for determining the feedback threshold and by using another microphone for determining the quality index.

16. The method of claim 15, characterized in that the two microphones belong to the same hearing device.

17. The method of claim 15, characterized in that one of the two microphones belongs to one hearing device, while the other microphone belongs to another hearing device, wherein both hearing devices belong to a binaural hearing system.

18. The method of claim 9, characterized in that the quality index is a noise level.

19. The method of claim 18, characterized in that a determined feedback threshold is considered to be final if the addition of the values for the noise level and for the determined feedback threshold is smaller than the maximum possible gain of the hearing device.

20. The method of claim 1, characterized by further comprising the step of determining maximum gains in the frequency bands ($FB_1, \ldots, FB_9$) or at the frequencies ($k_1, \ldots, k_9$) based on the corresponding feedback threshold determined in the particular frequency band ($FB_1, \ldots, FB_9$) or at the particular frequency ($k_1, \ldots, k_9$), respectively, the maximum gain being below the corresponding feedback threshold.

* * * * *